US009146569B2

(12) United States Patent
Li et al.

(10) Patent No.: US 9,146,569 B2
(45) Date of Patent: Sep. 29, 2015

(54) LOW DROP OUT REGULATOR AND CURRENT TRIMMING DEVICE

(71) Applicant: Macronix International Co., Ltd., Hsinchu (TW)

(72) Inventors: Chia-Ching Li, New Taipei (TW); Hsien-Hung Wu, Hsinchu (TW); Hsin-Yi Ho, Hsinchu (TW); Han-Sung Chen, Hsinchu (TW); Chun-Hsiung Hung, Hsinchu (TW); Tzung-Shen Chen, Taoyuan County (TW)

(73) Assignee: MACRONIX INTERNATIONAL CO., LTD. (TW)

( * ) Notice: Subject to any disclaimer, the term of this patent is extended or adjusted under 35 U.S.C. 154(b) by 162 days.

(21) Appl. No.: 13/862,963

(22) Filed: Apr. 15, 2013

(65) Prior Publication Data

US 2014/0266105 A1 Sep. 18, 2014

Related U.S. Application Data

(60) Provisional application No. 61/778,473, filed on Mar. 13, 2013.

(51) Int. Cl.
*G05F 1/00* (2006.01)
*G05F 1/565* (2006.01)

(52) U.S. Cl.
CPC ..... *G05F 1/565* (2013.01)

(58) Field of Classification Search
CPC ..... G05F 1/00; G05F 1/46; G05F 1/56; G05F 1/565
USPC ..... 323/234, 237, 265, 273–277, 282, 323/284–286
See application file for complete search history.

(56) References Cited

U.S. PATENT DOCUMENTS

| | | | | |
|---|---|---|---|---|
| 6,465,994 | B1 * | 10/2002 | Xi | 323/274 |
| 8,779,748 | B2 * | 7/2014 | Gotoh | 323/288 |
| 2005/0088159 | A1 * | 4/2005 | Itohara | 323/284 |
| 2008/0174289 | A1 * | 7/2008 | Gurcan et al. | 323/280 |
| 2008/0224675 | A1 * | 9/2008 | Takagi | 323/275 |
| 2009/0195227 | A1 * | 8/2009 | Morino | 323/224 |
| 2010/0289475 | A1 * | 11/2010 | Lipka | 323/315 |
| 2011/0215868 | A1 * | 9/2011 | Thakker et al. | 330/252 |
| 2012/0113684 | A1 * | 5/2012 | Wang et al. | 363/21.01 |
| 2013/0113447 | A1 * | 5/2013 | Kadanka | 323/280 |
| 2013/0241526 | A1 * | 9/2013 | Ozasa et al. | 323/314 |

* cited by examiner

*Primary Examiner* — Jeffrey Gblende
(74) *Attorney, Agent, or Firm* — Volpe and Koenig, P.C.

(57) ABSTRACT

A regulator comprises an amplifier, a bias circuit, and a current trimming circuit. The bias circuit is coupled to the amplifier and supplies a first bias current to the amplifier in a first mode of a system including the regulator. The current trimming circuit is coupled to the bias circuit to adjust the first bias current.

17 Claims, 12 Drawing Sheets

60

LOW DROP OUT REGULATOR AND CURRENT TRIMMING DEVICE

CROSS REFERENCE TO RELATED APPLICATIONS

This application claims the benefit of U.S. provisional application No. 61/778,473 filed Mar. 13, 2013, which is incorporated by reference as if fully set forth herein

TECHNICAL FIELD

Embodiments of the present disclosure are related to a circuit, and more particularly to a low drop-out regulator and current trimming device.

BACKGROUND

In recent years, the mobile device becomes more and more popular among the computer, the consumer, and the communication products. In particular, the mobile phone, the laptop, or the pad product is increasingly demanded and sold at a great percentage of the electrical devices around the world.

The major concern of those mobile phones is about the power consumption and the battery life thereof. The power management can improve the chip's power efficiency so as to prolong the battery life and the operating time.

Although the mobile phone is designed to have low power consumption, it still needs power to support a standby mode in order that it wakes up to receive a prepared call. Even if there is no voice communication, a power circuit of the mobile phone is still powered to allow a background communication called a "paging mode". While the mobile phone is inactive, most circuits of the mobile phone except the power circuit are shut down for saving the power consumption.

While the mobile phone is in the standby mode, the power circuit being the analog portion of the mobile phone is still active to power the digital portion of the mobile phone. For example, the power circuit is a low drop-out (LDO) regulator. The LDO regulator is an essential part of a power management system that provides a constant supply voltage. The conventional LDO regulator, for stability requirements, requires a relatively large-capacity output capacitor in the single microfarad range. A large-capacity microfarad capacitor cannot be realized into a chip, and thus each LDO regulator needs an external pin for a board-mounted output capacitor.

While the LDO regulator is powered, a quiescent current flowing therein makes power consumption; and the mobile phone often includes lots of LDO regulators, so that the total power consumption is relatively large. The quiescent current is defined as the operation current of the amplifier of the LDO regulator. A large-capacity off-chip external capacitor is used for frequency compensation.

Please refer to FIG. 1, which shows an LDO regulator circuit 10 in the prior art. The regulator circuit 10 includes a first amplifier 101, a second amplifier 102, a first bias current source 103, a second bias current source 104, a first switch 105, a second switch 106, a main bandgap circuit 107, an inverter 109, a power p-type metal oxide semiconductor (PMOS) transistor MP1, a divider portion DIVR1, an external load capacitor $C_{LOAD1}$, and an equivalent load $R_{LOAD1}$, wherein the divider portion DIVR1 includes resistors R1 and R2, and the equivalent load $R_{LOAD1}$ has a load current $I_{LOAD1}$ flowing therethrough.

The LDO regulator circuit 10 includes an LDO power supply unit; and the basic structure of the LDO power supply unit includes the power PMOS transistor MP1, the first amplifier 101, the first bias current source 103, the external load capacitor $C_{LOAD1}$, the divider portion DIVR1, and the main bandgap circuit 107. The output terminal EO1 of the first amplifier 101 is coupled to the gate G1 of the power PMOS transistor MP1; and the first bias current source 103 is coupled to the power PMOS transistor MP1. A system voltage $V_{IN}$ is supplied to the first amplifier 101, the second amplifier 102, and the source terminal S1 of the power PMOS transistor MP1. The main bandgap circuit 107 generates a reference voltage $V_{BG1}$ to be provided to the negative input of the first amplifier 101 and the negative input of the second amplifier 102. The divider portion DIVR1 provide a feedback voltage $V_{FB1}$ to the positive input of the first amplifier 101 and the positive input of the second amplifier 102.

For example, the first amplifier 101 is an error amplifier. When the magnitude of the feedback voltage $V_{FB1}$ is less than that of the reference voltage $V_{BG1}$, the first amplifier outputs a relatively low voltage level to turn on the power PMOS transistor MP1 for making a conduction between the source terminal S1 and the drain terminal D1 of the power PMOS transistor MP1. Thus the system voltage $V_{IN}$ can be supplied to the external load capacitor $C_{LOAD1}$, the divider portion DIVR1, and the equivalent load $R_{LOAD1}$. When the magnitude of the feedback voltage $V_{FB1}$ is larger than that of the reference voltage $V_{BG1}$, the first amplifier 101 outputs a relatively high voltage level to turn off the power PMOS transistor MP1 for reducing an output voltage $V_{OUT1}$ at the drain terminal D1 which is also an output terminal of the LDO power supply unit. The output voltage $V_{OUT1}$ has a waveform which is like a small sinusoid wave with a small swing. If the design of the LDO regulator circuit 10 is careless, the small wave will swing to be unlimited large increasingly, which results in an unstable power to be supplied to the load capacitor $C_{LOAD1}$ and the equivalent load $R_{LOAD1}$.

The inverter 109 coupled to the first switch 105 and the second switch 106 receives a control signal STBEN1 to turn on one of the first and the second switches 105 and 106 for enabling one of an active mode and a standby mode. When the first switch 105 is turned on and the second switch 106 is turned off, the LDO regulator circuit 10 enters the active mode and only the first bias current source 103 provides an active current Iq_act1 in the active mode. On the contrary, when the second switch 106 is turned on and the first switch 105 is turned off, the LDO regulator circuit 10 enters the standby mode and only the second bias current source 104 provides a standby current Iq_stb1 in the standby mode.

The second amplifier 102 may be designed to consume a less power than the first amplifier 101 consumes, and the second bias current source 104 can also be designed to provide less current than the first bias current source 103 provides. Thus, when a demand of the load current $I_{LOAD1}$ is light, the control signal STBEN1 can switch the LDO regulator circuit 10 into the standby mode for saving power; and when the demand of the load current $I_{LOAD1}$ is heavy, the control signal STBEN1 can switch the LDO regulator circuit 10 into the active mode for providing enough load current $I_{LOAD1}$. The load current $I_{LOAD1}$ is typically ranged from 10 μA to 100 mA according to the demand of the load current $I_{LOAD1}$, which can be light or heavy. However, the disadvantage is that the larger standby current Iq_stb1 will result in the power consumption even in the standby mode with very light current load.

The LDO regulator circuit 10 can save power owing to its lowered quiescent current. For example, the consumed current of the LDO regulator circuit 10 is reduced from the first bias current Iq_act1 in the active mode to the second bias current Iq_stb1 in the standby mode. However, it cannot be guaranteed that the LDO regulator circuit 10 can provide a stable power. In addition, the second amplifier 102 still occupies a large chip area, which can be eliminated.

Furthermore, it is also very important that the output voltage $V_{OUT1}$ provided by the LDO regulator circuit 10 can be stable and can be immune to the noise whether the LDO regulator circuit 10 is in the active mode or in the standby mode, and the quiescent current can still be reduced to minimum. Saving the chip area and saving the power consumption is also expected. Accordingly, there is a need for a method and an apparatus to reduce the power consumption, simultaneously keep the output voltage $V_{OUT1}$ in a relatively stable state, and have an economical chip area.

SUMMARY OF EXEMPLARY EMBODIMENTS

In accordance with one embodiment of the present disclosure, a regulator is provided. The regulator comprises an amplifier, a bias circuit, and a current trimming circuit. The bias circuit is coupled to the amplifier and supplies a first bias current to the amplifier in a first mode of a system including the regulator. The current trimming circuit is coupled to the bias circuit to adjust the first bias current.

In accordance with one embodiment of the present disclosure, a method of adjusting a bias current of a regulator is provided, the method comprises providing a plurality of current sources in parallel, providing codes to activate at least one of the plurality of current sources, and supplying the bias current to an amplifier in the regulator, wherein the bias current is generated by the at least one of the plurality of current sources.

In accordance with a further embodiment of the present disclosure, a current trimming device is provided. The current trimming device comprises a first device and a second device. The first device comprises a plurality of current sources in parallel and supplies a bias current to an amplifier. The second device activates at least one of the plurality of current sources based on a select signal.

The above embodiments and advantages of the present invention will become more readily apparent to those ordinarily skilled in the art after reviewing the following detailed descriptions and accompanying drawings.

BRIEF DESCRIPTION OF THE DRAWINGS

FIG. 3(*b*) shows a current trimming device according to a third preferred embodiment of the present disclosure;

FIG. 4(*b*) shows an LDO regulator circuit according to the second preferred embodiment of the present disclosure;

DETAILED DESCRIPTION OF THE PREFERRED EMBODIMENTS

Figure 1:
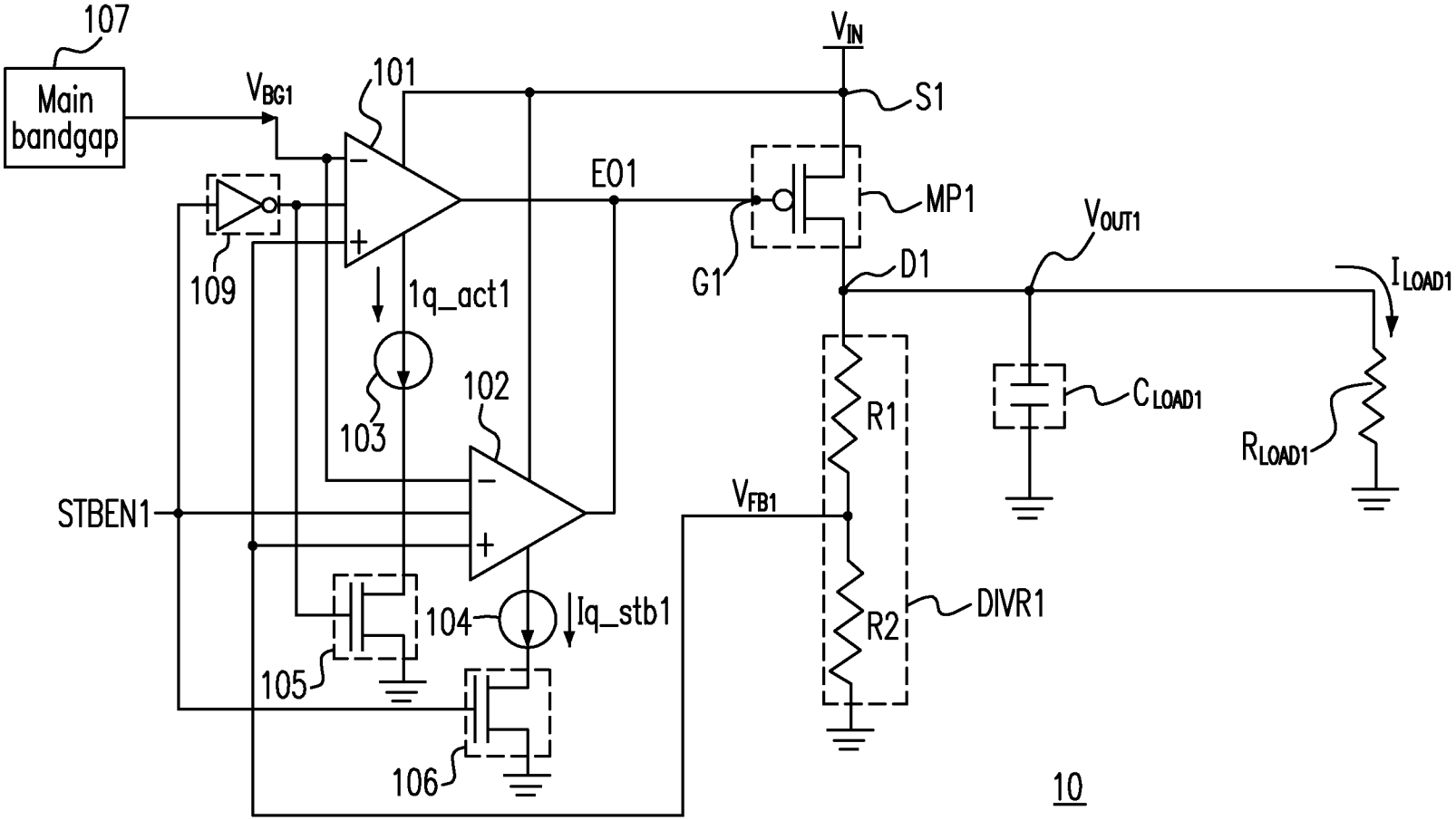
Fig. 1(Prior Art)
FIG. 1 shows an LDO regulator circuit in the prior art.
Figure 2:
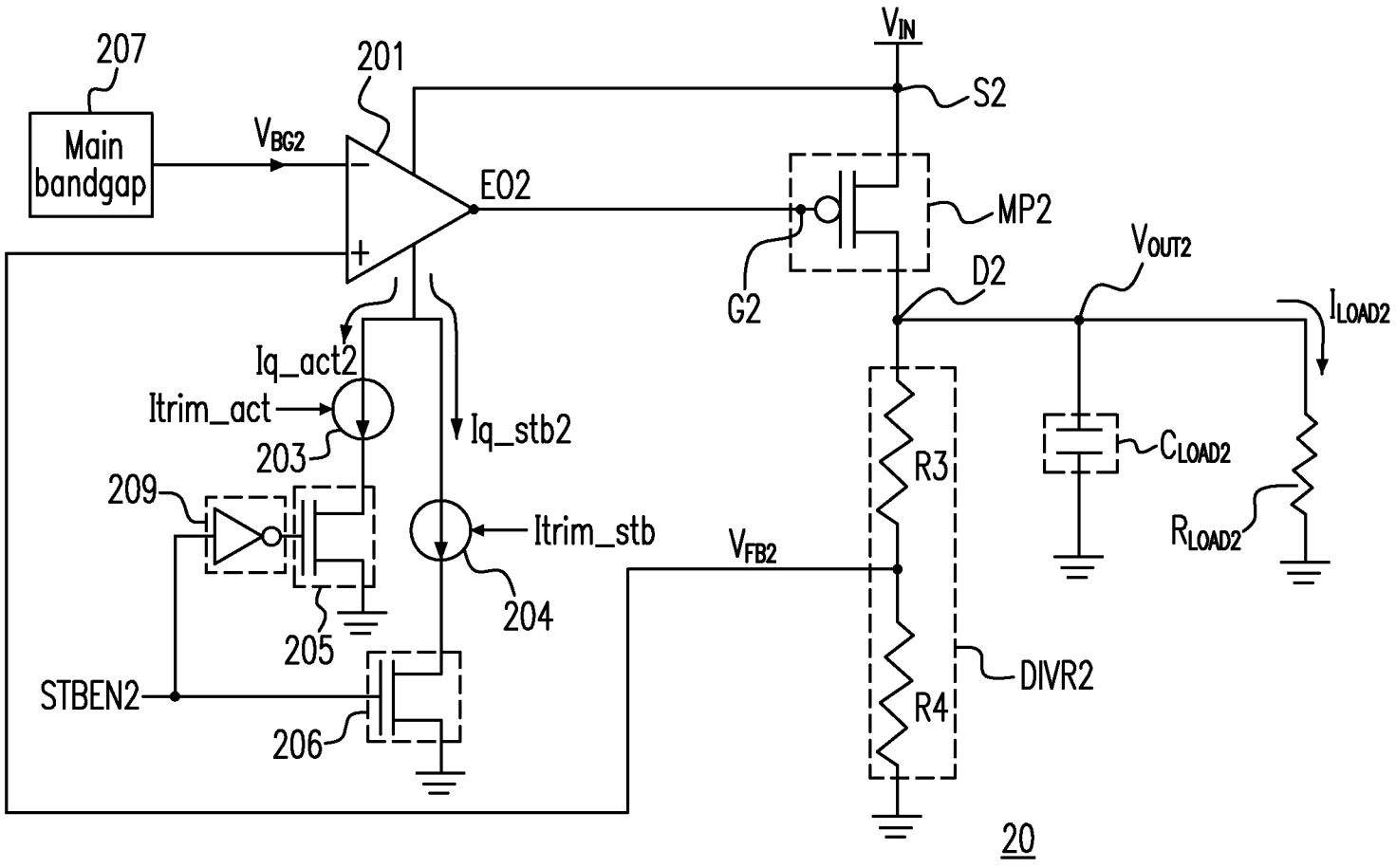
FIG. 2 shows an LDO regulator circuit according to a first preferred embodiment of the present disclosure.

Please refer to FIG. 2, which shows an LDO regulator circuit 20 according to a first preferred embodiment of the present disclosure. In FIG. 2, the LDO regulator circuit 20 includes an amplifier 201, a first bias current source 203 and a second bias current source 204. The amplifier 201 operates in one of a high current mode and a low current mode. The first bias current source 203 is coupled to the amplifier 201 and supplies a first bias current Iq_act2 to the amplifier 201 for operating the amplifier 201 in the high current mode. The second bias current source 204 is coupled to the amplifier 201 and supplies a second bias current Iq_stb2 to the amplifier 201 for operating the amplifier 201 in the low current mode.

The LDO regulator circuit 20 further comprises a power component, a first switch 205, a second switch 206, a main bandgap circuit 207, an inverter 209, a divider portion DIVR2, a load capacitor $C_{LOAD2}$ and an equivalent load $R_{LOAD2}$. For example, the power component is a power transistor (such as a power PMOS transistor MP2 of which the gate G2 is coupled to the output terminal EO2 of the amplifier 201); the second switch 206 is coupled to the second bias current source 204; the divider portion DIVR2 could be a voltage divider including resistors R3 and R4; the load capacitor $C_{LOAD2}$ is coupled to the drain terminal D2 of the power PMOS transistor MP2; and the equivalent load $R_{LOAD2}$ has a load current $I_{LOAD2}$ flowing therethrough.

In some embodiment, the second bias current source 204, the first switch 205, the second switch 206, and the inverter 209 can be omitted, only one bias current source supplies one of the first bias current Iq_act2 and the second bias current Iq_stb2 to the amplifier 201 respectively in one of the active mode and the standby mode by controlling codes from controller (not shown), which is described in later paragraphs.

The inverter 209 coupled to the first switch 205 and the second switch 206 receives a control signal STBEN2 to turn on one of the first and the second switches 205 and 206 for enabling one of the high current mode and the low current mode. The first switch 205 coupled between the first bias current source 203 and a ground terminal, a second switch 206 coupled between the second bias current source 204 and the ground terminal. For example, the high current mode is accompanied with an active mode under a condition that the load current $I_{LOAD2}$ is relatively high; and the low current mode is accompanied with a standby mode under a condition that the load current $I_{LOAD2}$ is relatively low. The first switch 205 and the second switch 206 can be two n-type metal oxide semiconductor (NMOS) transistor, respectively, as shown in FIG. 2. When the first switch 205 is turned on and the second switch 206 is turned off, the LDO regulator circuit 20 enters the active mode or the high current mode and only the first bias current source 203 provides the first bias current Iq_act2 in the high current mode. On the contrary, when the second switch 206 is turned on and the first switch 205 is turned off, the LDO regulator circuit 20 enters the standby mode or the low current mode and only the second bias current source 204 provides the second bias current Iq_stb2 in the low current mode.

The system voltage $V_{IN}$ is supplied to the amplifier 201, the source terminal S2 of the power PMOS transistor MP2. The main bandgap circuit 207 generates a reference voltage $V_{BG2}$ to be provided to the negative input of the amplifier 201. The reference voltage $V_{BG2}$ is a constant which is independent of the temperature and the process variations. The divider portion DIVR2 provide a feedback voltage $V_{FB2}$ to the positive input of the amplifier 201. More practically, the first bias current source 203 and the second bias current source 204 are directly connected to the amplifier 201.

For example, the amplifier 201 is an error amplifier. When the magnitude of the feedback voltage $V_{FB2}$ is less than that of the reference voltage $V_{BG2}$, the amplifier 201 outputs a relatively low voltage level to turn on the power PMOS transistor MP2 for making a conduction between the source terminal S2 and a drain terminal D2 of the power PMOS transistor MP2. Thus the system voltage $V_{IN}$ can be supplied to the load capacitor $C_{LOAD2}$, the divider portion DIVR2, and the equivalent load $R_{LOAD2}$. When the magnitude of the feedback voltage $V_{FB2}$ is larger than that of the reference voltage $V_{BG2}$, the first amplifier outputs a relatively high voltage level to turn off the power PMOS transistor MP2 for reducing an output voltage $V_{OUT2}$ at the drain terminal D2. The output voltage $V_{OUT2}$ has a waveform which is like a small sinusoid wave with a small swing. However, the proposed LDO regulator circuit 20 can suppress the small swing from being unlimitedly large.

In some embodiments, the LDO regulator circuit 20 can use a power NMOS transistor to implement the power PMOS transistor MP2 instead. Under this condition, the partial voltage $V_{FB2}$ is supplied to the positive input terminal of the amplifier 201 when the power transistor is a p-type transistor, and the partial voltage $V_{FB2}$ is supplied to the negative input terminal of the amplifier 201 when the power transistor is an n-type transistor.

In some embodiments, the first bias current Iq_act2 and the second bias current Iq_stb2 are fixed after a calibration is made for stabilizing the output voltage $V_{OUT2}$ or the load current $I_{LOAD2}$. In other embodiment, the first bias current Iq_act2 and the second bias current are variable and can be controlled by a first current trimming signal Itrim_act and a second current trimming signal Itrim_stb respectively.

Figure 3A:
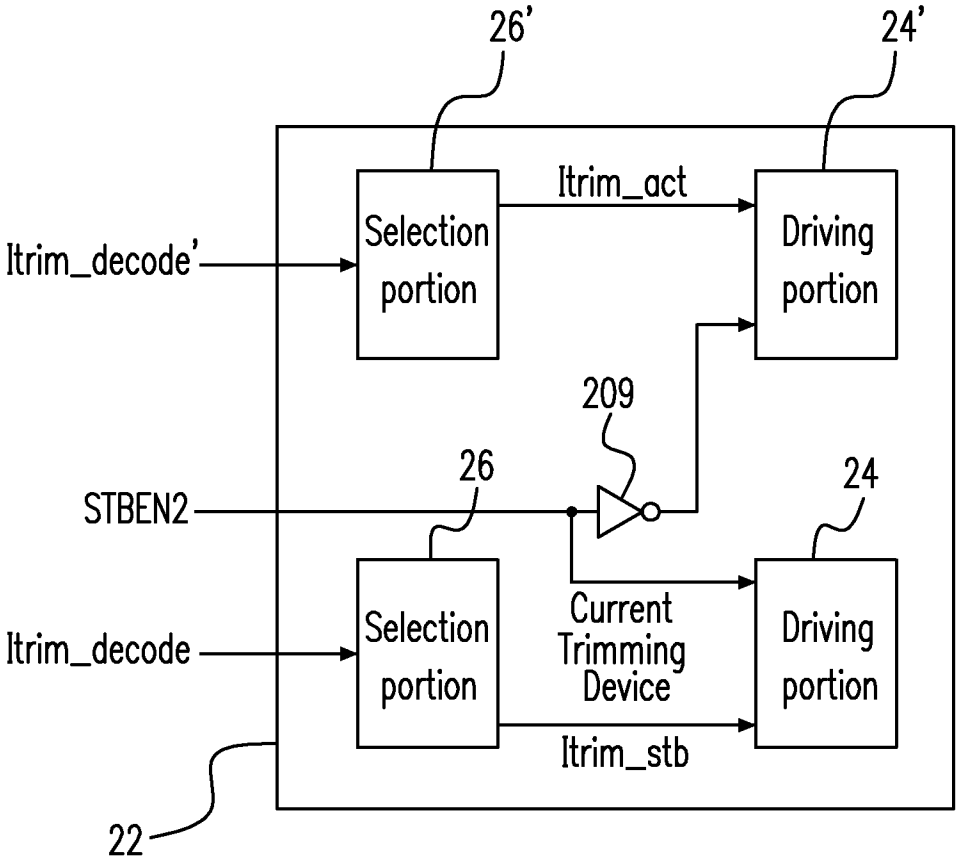
FIG. 3(*a*) shows a current trimming device according to a second preferred embodiment of the present disclosure.
Figure 3B:
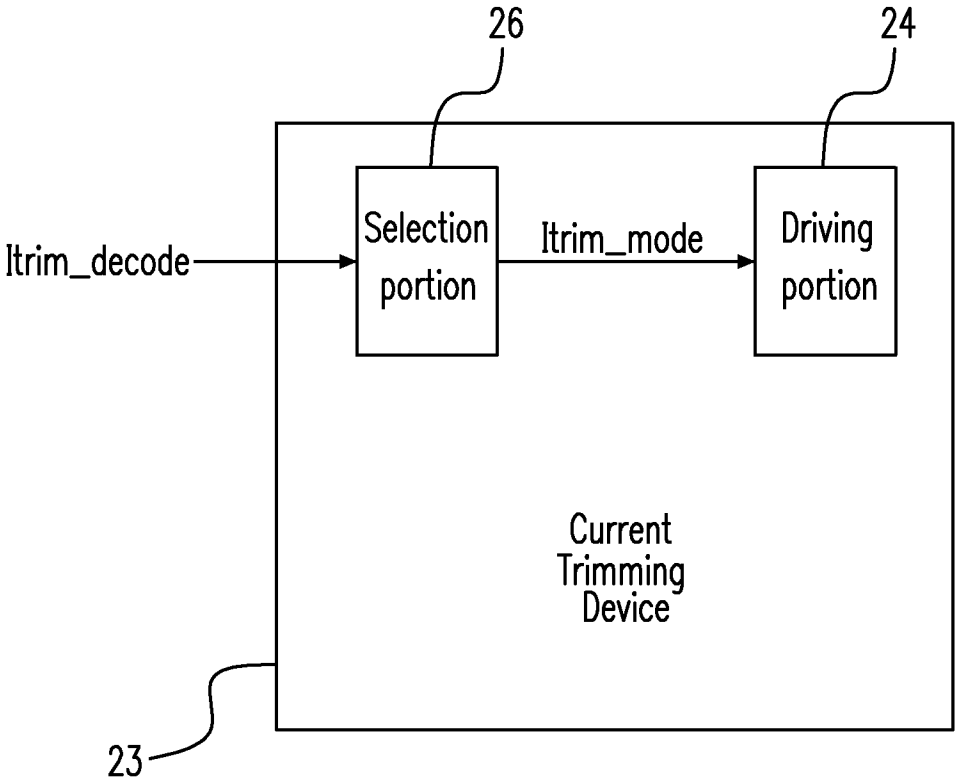

Please refer to FIG. 3(*a*), which shows a current trimming device 22 according to a second preferred embodiment of the present disclosure. In some embodiments, the current trim device 22 is used for stabilizing the output voltage $V_{OUT2}$ regardless which mode the regulator is working in. In the second preferred embodiment, the LDO regulator circuit 20 further includes the current trimming device 22. The current trimming device 22 includes driving portions 24, 24' and selection portions 26, 26', and receives the control signal STBEN2 and a trim decode signal Itrim_decode, Itrim_decode' from controller unit, such as micro controller (not shown). In FIG. 3(*a*), driving portion 24 is only operated in the active mode, driving portion 24' is only operated in the standby mode, the control signal STBEN2 enables only one of driving portions 24, 24' at one time, so that the LDO regulator circuit 20 can be switched between the active mode and the standby mode. The selection poetions 26, 26' are in response to the trim decode signal Itrim_decode, Itrim_decode' to output the first current trimming signal Itrim_act and the second current trimming signal Itrim_stb respectively. In this way, both of the first bias current Iq_act2 and the second bias current Iq_stb2 are adjustable for causing the output voltage $V_{OUT2}$ to be in a relatively stable state. For example, when the load current $I_{LOAD2}$ is small, the standby current Iq_stb2 can be lowered to save a supplying power without sacrificing the stability of the supplying power of the LDO regulator circuit 20.

Figure 4A:
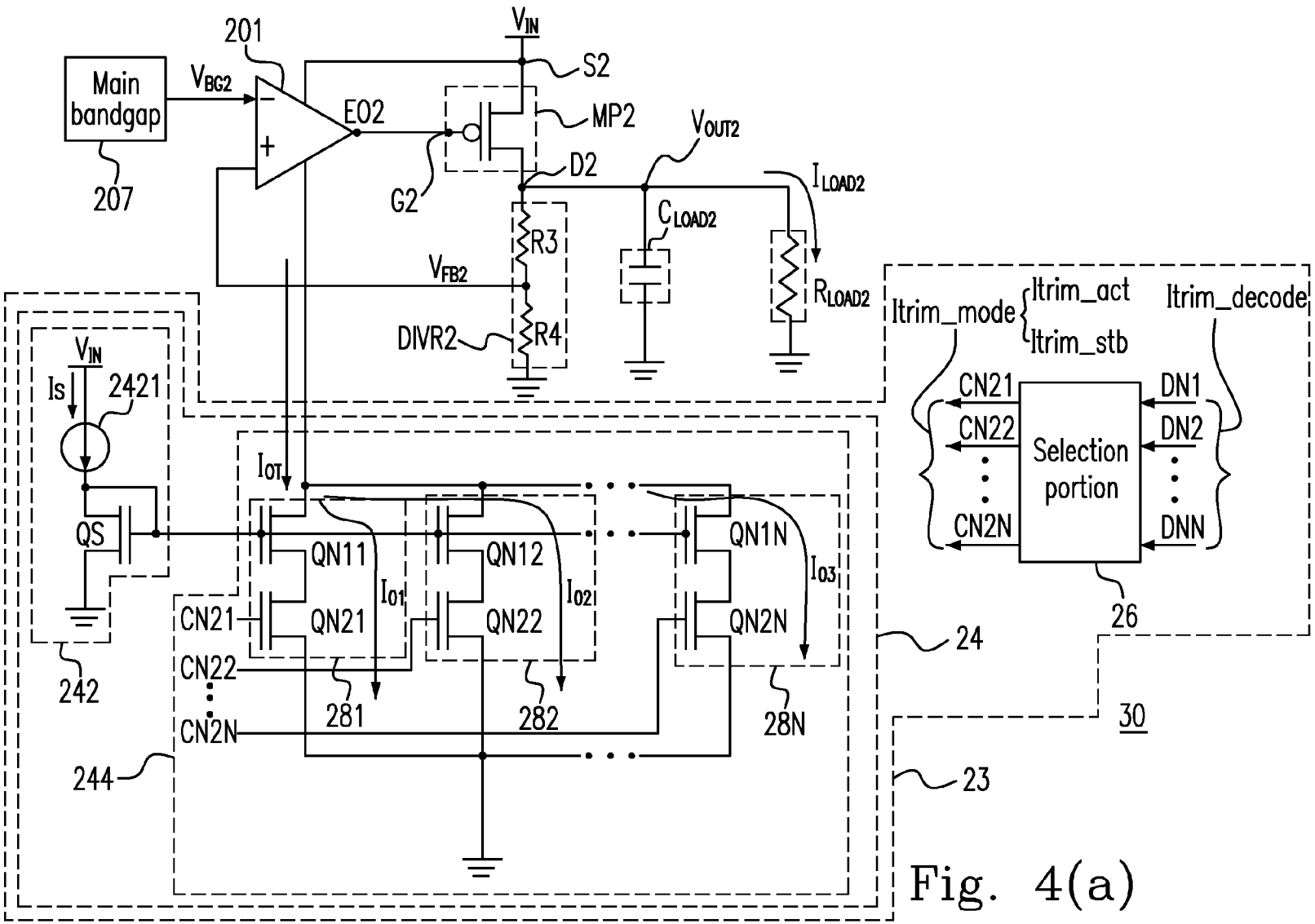
FIG. 4(*a*) shows an LDO regulator circuit according to the third preferred embodiment of the present disclosure.
Figure 4B:
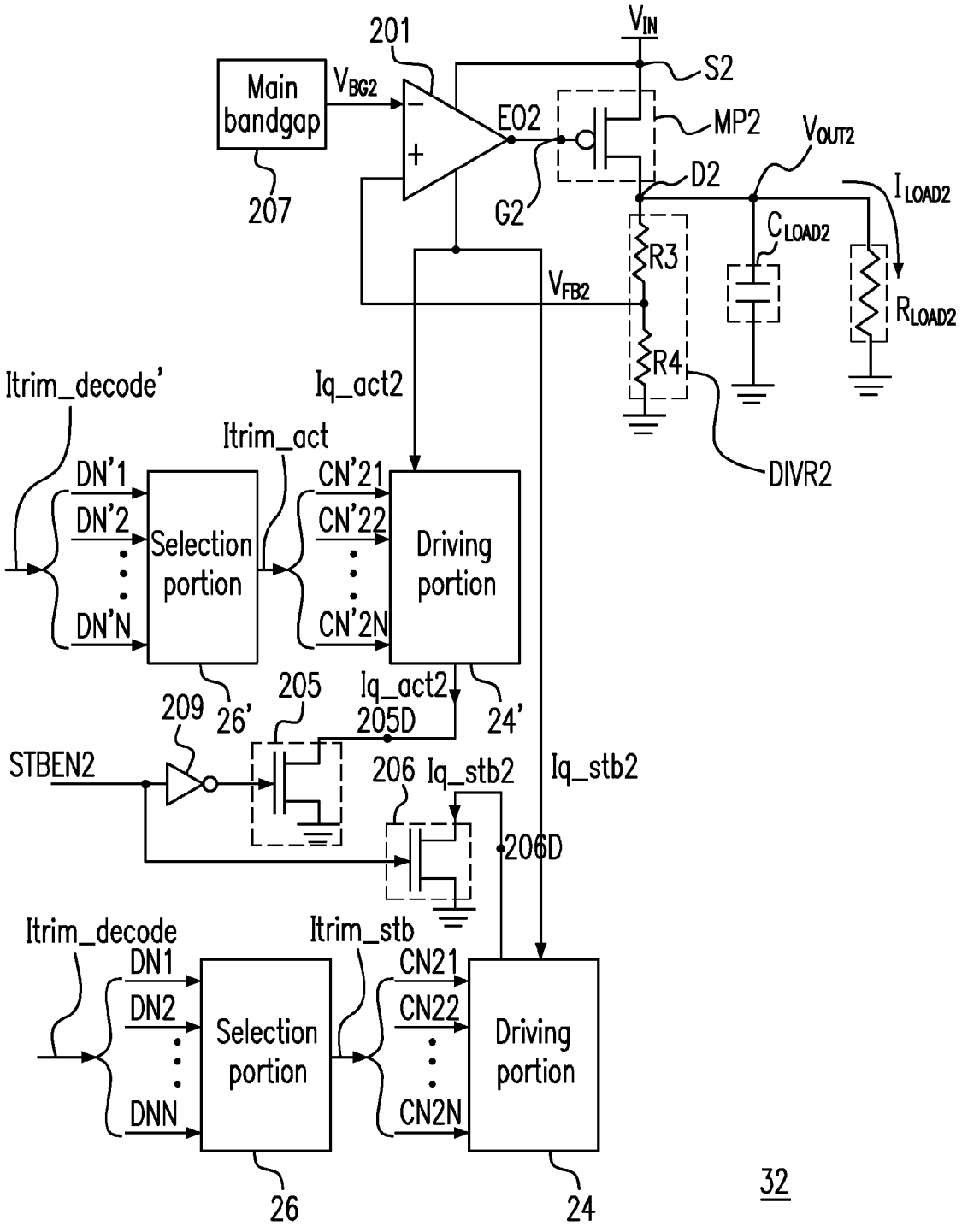

Please refer to FIG. 3(*b*), which shows a current trimming device 23 according to a third preferred embodiment of the present disclosure. The current trimming device 23 includes a driving portion 24 and a selection portions 26, and receives a trim decode signal Itrim_decode from controller unit. In FIG. 3(*b*), driving portion 24 is in response to signal Itrim_mode to be operated in one of the active mode and the standby mode, so that the LDO regulator circuit 20 can be switched between the active mode and the standby mode. The selection portion 26 is in response to the trim decode signal Itrim_decode to output one of the first current trimming signal Itrim_act and the second current trimming signal Itrim_stb as shown in FIG. 4(*a*). In this way, both of the first bias current Iq_act2 and the second bias current Iq_stb2 are adjustable for causing the output voltage $V_{OUT2}$ to be in a relatively stable state.

Please refer to FIG. 4(*a*), which shows the LDO regulator circuit according to the third preferred embodiment of the present disclosure. The third preferred embodiment shows that only one driving portion 24 is applied to be switched between active mode or standby mode. Another embodiment showing that two driving portions are applied to be switched in active mode or standby mode respectively will follow. The LDO regulator circuit 30 includes the similar circuit structure and components as those shown in FIG. 2 except the bias current sources. In FIG. 4(*a*), for example, the driving portion 24 is a current mirror, which includes a current source unit 242 and a current drive unit 244. The current source unit 242 includes a transistor QS and a independent current source 2421. The current drive unit 244 can generate a plurality of different bias currents for driving the amplifier 201. The control signal STBEN2 can turn on or turn off the second switch 206 to enable or disable the driving portion 24. The standby mode and the active mode in FIG. 4(*a*) is switched by changing code.relative signal, the trim decode signal Itrim_decode, for turning on a different combination of transistors in the standby mode and in the active mode respectively. The selection portion 26 can select one of the plurality of different bias currents based on a determination that the selected bias current and the load current $I_{LOAD2}$ are optimal.

In FIG. 4(*a*), the current drive unit 244 includes a plurality of different driving NMOS transistors QN11, QN12, . . . , QN1N, and a plurality of NMOS transistors such as switches QN21, QN22, . . . , QN2N respectively. In some embodiments, the current drive unit 244 includes a plurality of drive sub-units 281, 282, . . . , 28N. The drive sub-unit 281 includes the driving NMOS transistor QN11 and the NMOS switch QN21; the drive sub-unit 282 includes the driving NMOS transistor QN12 and the NMOS switch QN22; and the others are similar. Each of the plurality of different driving NMOS transistors QN11, QN12, . . . , QN1N has different driving ability for supplying a respective suitable bias current because the driving NMOS transistors QN11, QN12, . . . , QN1N have different gate channel width versus gate channel length ratios respectively. Therefore, by selecting only one NMOS switch from the switches QN21, QN22, . . . , QN2N, one of a plurality of bias currents $I_{O1}$, $I_{O2}$, . . . $I_{ON}$ can be used to drive the amplifier 201. For example, the ratios of the gate channel width versus gate channel length of the driving NMOS transistor QN11, QN12, . . . , QN1N are R1, R2, . . . , RN respectively, and R1<R2< . . . <RN. The selection portion 26 outputs the signal Itrim_mode including the select signals CN21, CN22, . . . , CN2N in response to the trim decode signal Itrim_decode including decode signals DN1, DN2, . . . , DNN. The signal Itrim_mode including the select signals CN21, CN22, . . . , CN2N is the signal Itrim_act, which is controlled by codes from controller. When the select signal CN21 has the relatively high voltage level and each of the rest select signals CN22, . . . , CN2N has the relatively low voltage level, only the corresponding NMOS switch QN21 is turned on, and thus only the driving NMOS transistor QN11 of the driving unit 244 provides the smallest bias current $I_{O1}$ for driving the amplifier 201, which substantially equals to a total bias current $I_{OT}$ provided for driving the amplifier 201. During a first trial run process, the LDO regulator circuit 30 can include the driving portion 24 and the selection portion 26, and runs a fine tune to determine what range of the bias current is appropriate. After all the functions are verified, a satisfactory drive sub-unit is selected from the plurality of drive sub-units 281, 282, . . . , 28N and is kept in the LDO regulator circuit 30. For example, a specific condition is predetermined by a circuit simulation to be that the selected bias current and the load current $I_{LOAD2}$ are optimal, and the satisfactory drive sub-unit causes the specific condition to be satisfied. For example, when the bias current $I_{O1}$ fits the desired bias current and the output voltage VOUT2 can be keep stable, it is preferred to keep the drive sub-unit 281, including the driving NMOS transistor QN11 and the NMOS switch QN21, for supplying the desired bias current, and remove the rest components (such as the drive sub-units 282, . . . , 28N) for saving a chip area. In one embodiment, each of the plurality of different driving NMOS transistors QN11, QN12, . . . , QN1N has the same driving ability for supplying a respective suitable bias current by selecting a optimal combination of the NMOS switches QN21, QN22, . . . , QN2N.

In FIG. 4(*a*), the selection portion 26 can be a decoder which receives decode signals DN1, DN2, . . . , DNN. In some embodiments, the selection portion 26 can select to enable at least two of the plurality of drive sub-units 281, 282, . . . , 28N (such as at least one of NMOS switches QN21, QN22, . . . , QN2N), and the ratios R1, R2, . . . , RN have relationships of $R2=(2^1)*R1$, $R3=(2^2)*R1$, . . . , $RN=(2^{N-1})*R1$ respectively, so that the bias current have relationships of $I_{O2}=(2^1)*I_{O1}$, . . . , and $I_{ON}=(2^{N-1})*I_{O1}$ respectively. The total bias current $I_{OT}$ can be varied by turning on an optimal combination of the different driving NMOS transistors QN11, QN12, . . . , QN1N. The decode signals DN1, DN2, . . . , DNN control the selection portion 26 to select at least one of the NMOS switches QN21, QN22, . . . , QN2N for conducting one or more than one driving NMOS. For example, in the active mode (or high current mode), a desired bias current is three times as high as the smallest bias current $I_{O1}$ in the standby mode (or low current mode). In order to achieve this purpose, the controller changes codes and sends it to the selection portion 26, i.e., the trim decode signal Itrim_decode signal DN1, DN2, . . . , DNN will change, each of the select signals CN21 and CN22 is set to be logically high (such as the relatively high voltage level) to turn on the corresponding NMOS switches QN21 and QN22 and each of the rest select signals are set to be logically low (such as the relatively low voltage level) to turn off the rest NMOS switches. As a result, the bias currents $I_{O1}$ and $I_{O2}=2*I_{O1}$ can flow through the driving NMOS transistors QN11 and QN12 respectively, and the total bias current $I_{OT}$ substantially equals to a sum of the bias currents $I_{O1}$ and $I_{O2}$., i.e., $I_{OT}=I_{O1}+I_{O2}=3*I_{O1}$.

The total bias current $I_{OT}$ is dynamically adjustable according to whether the load current $I_{LOAD2}$ is high or low. For example, if the load current $I_{LOAD2}$ measured is high, which is typically ranged around 100 mA, a first command can set the control unit to send the trim decode signal Itrim_decode to the selection portion 26, then the selection portion 26 send the signal Itrim_mode to turn on corresponding NMOS switches QN21, QN22, . . . , QN2N for having the total bias current $I_{OT}$ to be high, which is typically ranged around 600 μA. Similarly, if the if the load current $I_{LOAD2}$ measured is low, which is typically ranged 10 μA~2 mA, a second command can set the control unit to send the trim decode signal Itrim_decode to the selection portion 26, then the selection portion 26 send the signal Itrim_mode to turn on corresponding NMOS switches QN21, QN22, . . . , QN2N for having the total bias current $I_{OT}$ to be low, which is typically ranged around 60 μA.

In one embodiment in FIG. 4(*a*), the current drive unit 244 can include a plurality of different driving NMOS transistors QN11, QN12, . . . , QN1N, and a plurality of PMOS transistors such as switches (not shown), which are coupled to the driving NMOS transistors QN11, QN12, . . . , QN1N respectively, and a plurality of NMOS switches QN21, QN22, . . . , QN2N coupled to the driving NMOS transistors QN11, QN12, . . . , QN1N respectively. Similarly, by circuit simulation for selecting only one sub-set or a optimal combination of sub-set, the total bias current $I_{OT}$ can be optimal In one embodiment in FIG. 4(*a*), the current driving unit can have a cascade form.

Please refer to FIG. 4(*b*), which shows the LDO regulator circuit 32 according to the second preferred embodiment of the present disclosure in FIG. 3(*a*). The second preferred embodiment shows that two driving portions 24, 24' are applied to be switched in active mode or standby mode respectively. The LDO regulator circuit 32 has similar circuit structure as FIG. 4(*a*); however, the differences are two section portions 26, 26', two driving portions 24, 24', and the inverter 209 for switching the active mode and the standby mode between the two driving portions 24, 24' by enabling one of the first switch 205 and the second switch 206. Please note that all the source terminals of NMOS switches QN21, QN22, . . . , QN2N in the driving portion 24 of FIG. 4(*a*) are connected to ground, however; in the driving portion 24 of FIG. 4(*b*), they are connected to drain terminal 206D of the second switch 206. Similarly, all the source terminals of NMOS switches QN21, QN22, . . . , QN2N in the driving portion 24' are connected to drain terminal 205D of the first switch 205. The driving portion 24' has the same circuit structure with the driving portion 24 in FIG. 4(*a*), but can receive different select signals CN'21, CN'22, . . . , CN'2N. The selection portion 26' has the same circuit structure with the driving portion 26 in FIG. 4(*a*), but can receive different trim decode signal Itrim_decode' including DN'1, DN'2, . . . , DN'N. The trim decode signal Itrim_decode' including DN'1, DN'2, . . . , DN'N is the signal Itrim_stb, which is controlled by codes from controller. Both of the first bias current Iq_act2 and the second bias current Iq_stb2 can be adjustable individually, but only one of them is provided to the corresponding driving portion because the control signal STBEN2 only enable one of driving portion 24 and driving portion 24'.

Figure 5:
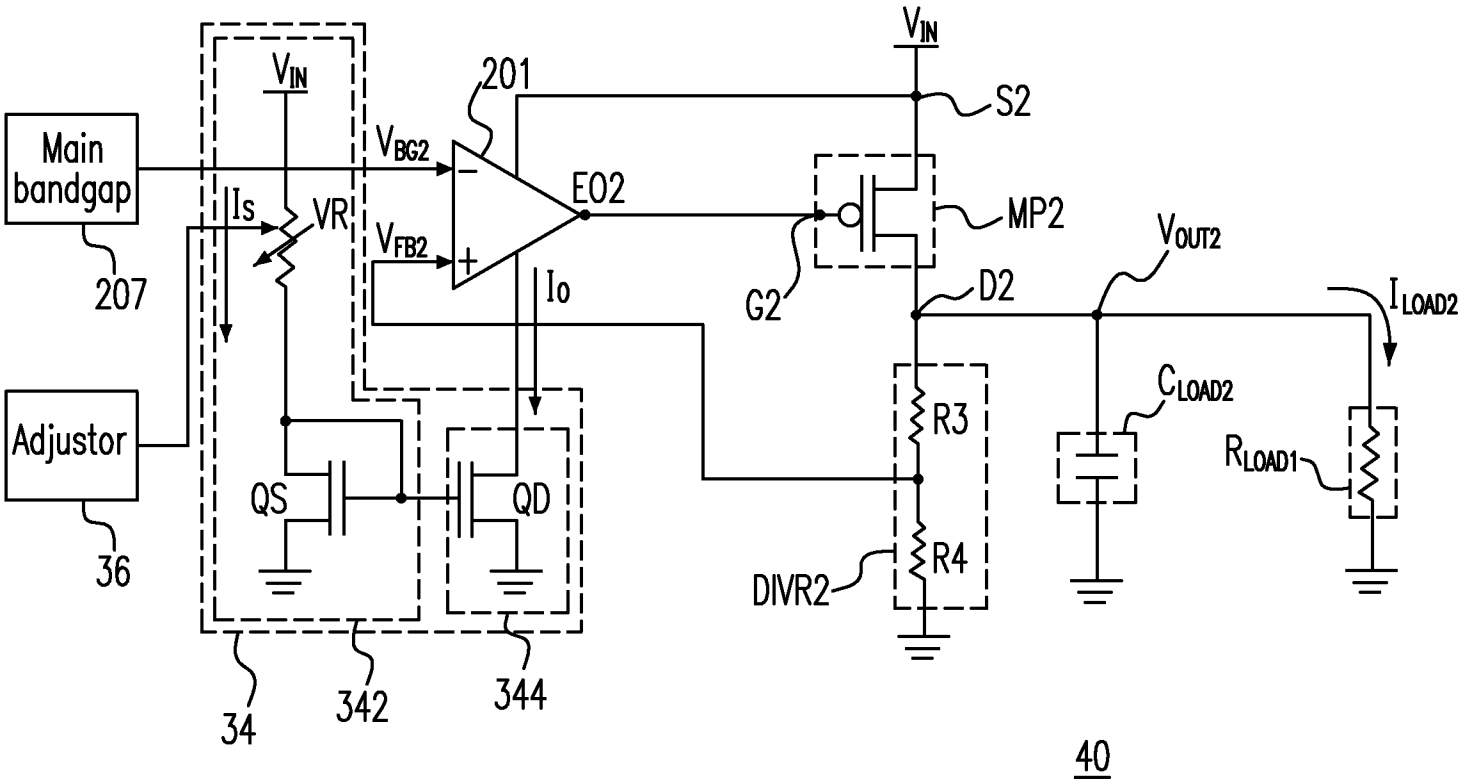
FIG. 5 shows an LDO regulator circuit according to a fourth preferred embodiment of the present disclosure.

Please refer to FIG. 5, which shows an LDO regulator circuit 40 according to a fourth preferred embodiment of the present disclosure. The LDO regulator circuit 40 includes the amplifier 201, the main bandgap circuit 207, the power PMOS transistor MP2, the divider portion DIVR2, the load capacitor $C_{LOAD2}$, the equivalent load $R_{LOAD2}$, a driving portion 34 and a adjustor 36. The power PMOS transistor MP2 of which the gate G2 is coupled to the output terminal EO2 of the amplifier 201. The divider portion DIVR2 includes resistors R3 and R4; the load capacitor $C_{LOAD2}$ is coupled to the drain terminal D2 of the power PMOS transistor MP2; the equivalent load $R_{LOAD2}$ has the load current $I_{LOAD2}$ flows there through; and driving portion 34 includes a current source unit 342 and a current drive unit 344. The current source unit 342 includes a variable resistor VR and the transistor QS. A resistance of the variable resistor VR is adjustable by the adjustor 36, so as to control the source current $I_S$ for supplying a drive current $I_O$ to the amplifier 201.

In some embodiment in FIG. 5, the LDO regulator can include the driving portion 34 and a driving portion 34' having the same structure with the driving portion 34, both of driving portions 34, 34' are directly connected to the amplifier 201, and an inverter (not shown) is coupled to both of driving portions 34, 34' which are applied to be switched between the active mode and the standby mode respectively as the second preferred embodiment.

Figure 6:
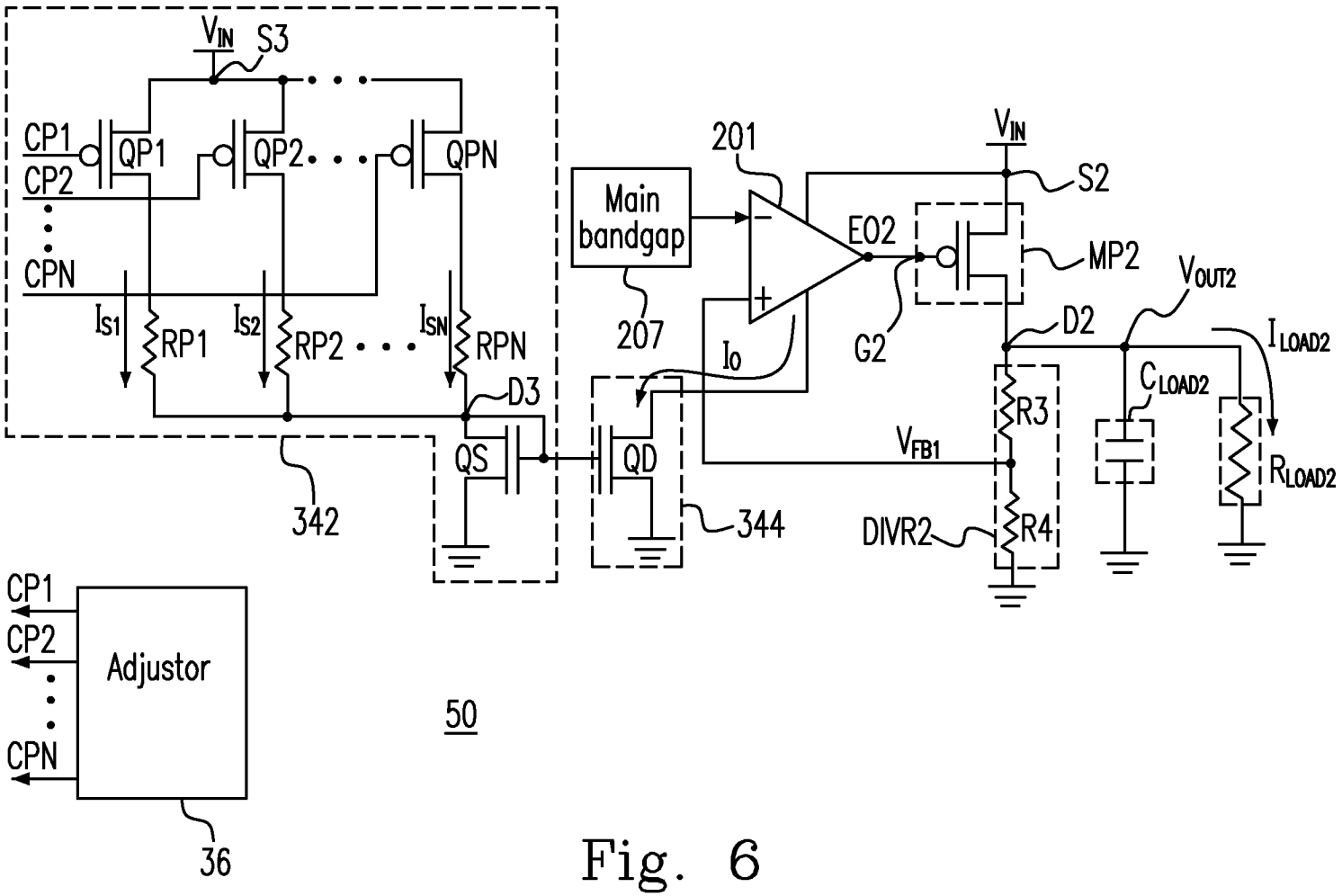
FIG. 6 shows a realization structure of an LDO regulator circuit according to the fourth preferred embodiment of the present disclosure.

Please refer to FIG. 6, which shows an LDO regulator circuit 50 according to the fourth preferred embodiment of the present disclosure. The LDO regulator circuit 50 is a realization structure of the LDO regulator circuit 40, wherein the current source unit 342 of the regulator circuit 50 is a detailed structure of the current source unit 342 of the LDO regulator circuit 40. The current source unit 342 in FIG. 6 includes at least one PMOS transistor (such as switches QP1, QP2, . . . , QPN), and at least one resistor (such as resistors RP1, RP2, . . . , RPN), wherein the resistors RP1, RP2, . . . , RPN are coupled to the PMOS switches QP1, QP2, . . . , QPN, respectively. The adjustor 36 can be a decoder or a selector to choose only one from the PMOS switches QP1, QP2, . . . , QPN according to a predetermined value of the drive current $I_O$. For example, the resistors RP1, RP2, . . . , RPN have resistances RV1, RV2 . . . , RVN respectively, and RV1> RV2> . . . >RVN. Only one of the select signals CP1, CP2, . . . , CPN from the adjustor 36 is configured to turn on only one PMOS switch of the PMOS switches QP1, QP2, . . . , QPN. When a source current $I_S$ is configured to have a smallest value according to the predetermined drive current $I_O$, the corresponding select signal CP1 is set to be logically low to turn on the corresponding PMOS switch QP1, and only the source current $I_{S1}$ flows through the resistor RP1, so that the corresponding drive current $I_O$ is accordingly provided for driving the amplifier 201.

In one embodiment, the resistances RV1, RV2 . . . . , RVN are equal, and each of the resistances RV1, RV2 . . . . , RVN has a resistance value RV. An combination of the select signals CP1, CP2, . . . , CPN from the adjustor 36 turns on at least one PMOS switch of the PMOS switches QP1, QP2, . . . , QPN. When only one of the PMOS switches QP1, QP2, . . . , QPN is turned on, the equivalent resistance between source S3 of the PMOS switches QP1, QP2, . . . , QPN and drain D3 of the transistor QS has the resistance value RV. When only two of the PMOS switches QP1, QP2, . . . , QPN is turned on, the equivalent resistance between source terminal S3 of the PMOS switches QP1, QP2, . . . , QPN and drain terminal D3 of the transistor QS has a resistance value of (½)*RV, which equals to the resistance value of two resistors connected in parallel. When only a sub-set of the PMOS switches QP1, QP2, . . . , QPN having a number of n is turned on, the equivalent resistance between source terminal S3 of the PMOS switches QP1, QP2, . . . , QPN and drain terminal D3 of the transistor QS has a resistance value of (1/n)*RV. Therefore, the more the PMOS switches are turned on, the lower resistance value the equivalent resistance has; i.e., under this condition, an equivalent source current being a sum of the source current $I_{S1}, I_{S2}, \ldots, I_{SN}$ increases, and the drive current $I_O$ increases accordingly.

Figure 7:
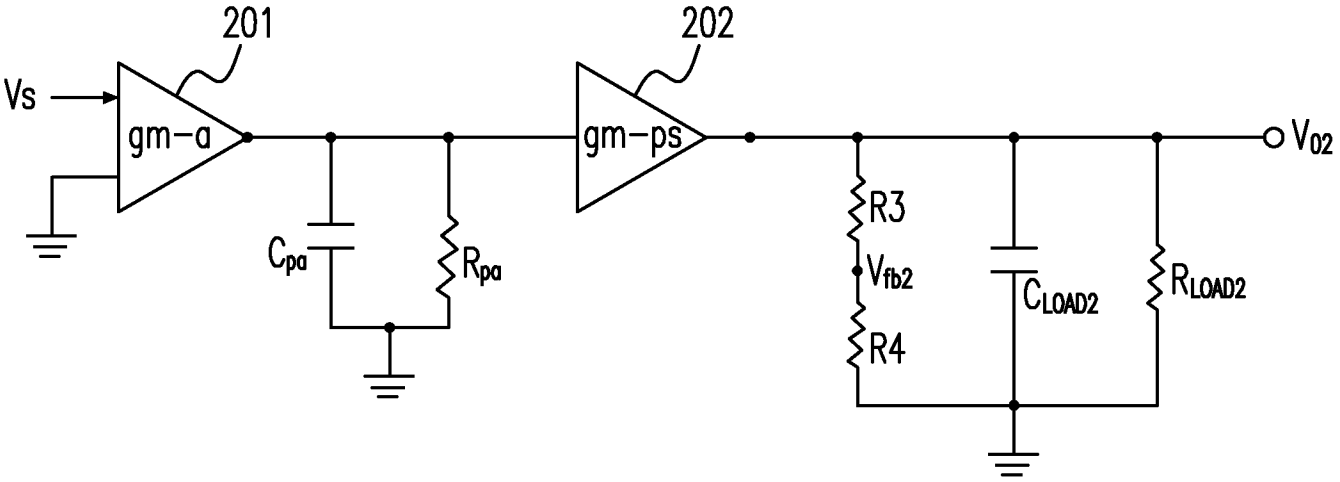
FIG. 7 shows an AC equivalent open loop circuit of the LDO regulator circuit in FIG. 2.

Please refer to FIG. 7, which shows an AC equivalent open loop circuit 60 of the LDO regulator circuit 20 in FIG. 2. The power PMOS transistor MP2 can be regard as a power component having a trans-conductance gm-ps, and the amplifier 201 having a trans-conductance gm-a receives an ac small feedback voltage Vs. The AC equivalent open loop circuit 60 further includes a capacitor Cpa and a resistor Rpa which are an output capacitor and an output resistor of the amplifier 201 respectively. The voltage $V_{fb2}$ is a partial voltage of an output voltage $V_{O2}$, wherein the output voltage $V_{O2}$ may swing to infinity when the output voltage $V_{O2}$ is unstable. A transfer function T(s) of the AC equivalent open loop circuit 60 is $(V_{fb2}/Vs)=(R4/(R3+R4))*(gm\text{-}a)*(Rpa+1/(s*Cpa))*(gm\text{-}ps)*Zout$ (Eq. 1), wherein $Zout=(R3+R4)//(1/(s*C_{LOAD2}))//R_{LOAD2}$. A first pole of a bode plot of the AC equivalent open loop circuit 60 frequency response is determined by a load capacitance of the load capacitor $C_{LOAD2}$ and a load resistance of the equivalent load $R_{LOAD2}$. A second pole is determined by a parasitical capacitance of the capacitor Cpa and a parasitical resistance of the resistor Rpa. The capacitor Cpa and the resistor Rpa are also a parasitical capacitor and a parasitical resistor of the power PMOS MP2 respectively.

Figure 8:
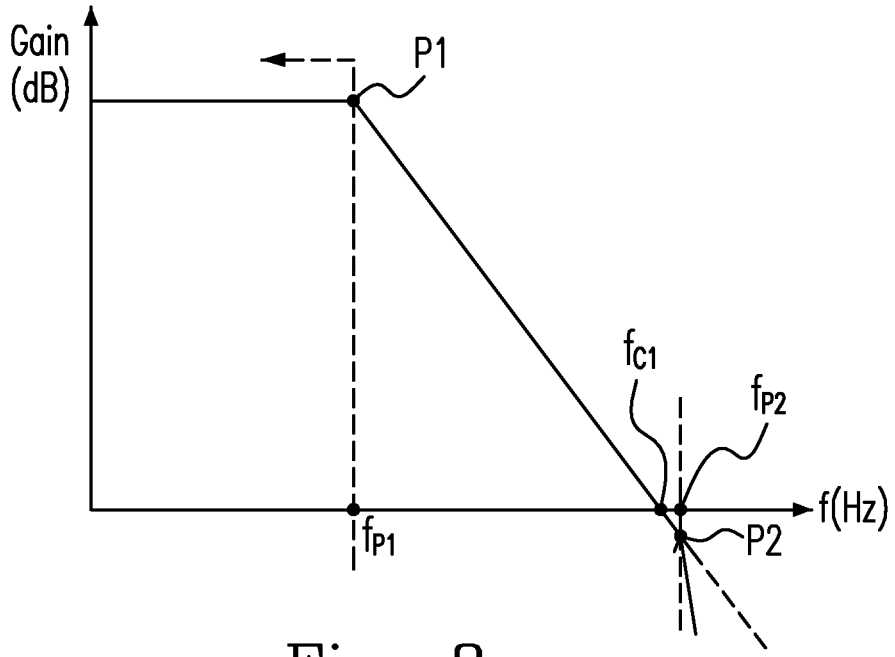
FIG. 8 shows a bode plot of the frequency response of a signal having the output voltage with reference to FIGS. 2 and 7.

Please refer to FIG. 8, which shows a bode plot of the frequency response of an output signal which has the output voltage $V_{O2}$ with reference to FIGS. 2 and 7. The horizontal axis shows the frequency of the output voltage $V_{O2}$ having a unit of hertz. The vertical axis shows a gain of the output voltage $V_{O2}$ having a unit of decibel. According to Eq. 1, the bode plot of the frequency response of the output voltage $V_{O2}$ is drawn in FIG. 8. In FIG. 8, a movement of the first pole P1 is in response to the load current $I_{LOAD2}$. For example, the load current $I_{LOAD2}$ is decreased from a high current to a low current; a typical high current value is about 100 mA and a typical low current value is about 10 μA; and the first pole P1 moves towards a direction of low frequency. Because the first pole P1 has a first pole frequency (also called 3 db frequency) $f_{P1}=1/(2\pi*R_{LOAD2}*C_{LOAD2})$ derived from Eq. 1, the decreased load current $I_{LOAD2}$ in standby mode means that the equivalent load $R_{LOAD2}$ increases, and thus the first pole frequency $f_{P1}$ is decreased. The second pole P2 has a frequency $f_{P2}$ which is over a first cut off frequency $f_{C1}$. The cut off frequency can determine the stability of the output voltage $V_{O2}$. When a phase of the output voltage $V_{O2}$ is fall behind over 180 degree at the first cut off frequency $f_{C1}$, the swing of the output voltage $V_{O2}$ is unstable and the amplitude of the swing may be increased to infinity. When the first pole P1 and the second pole P2 are too close, the swing of the output voltage $V_{O2}$ can also be caused to be unstable. There are some techniques can improve these situations. In some embodiments, the second pole P2 moves towards the direction of low frequency for obtain an additional phase margin when the first pole moves towards the direction of low frequency without sacrificing the stability, which can save power consumption as well. In one embodiment, the first pole also moves in response to the load capacitance.

Figure 9:
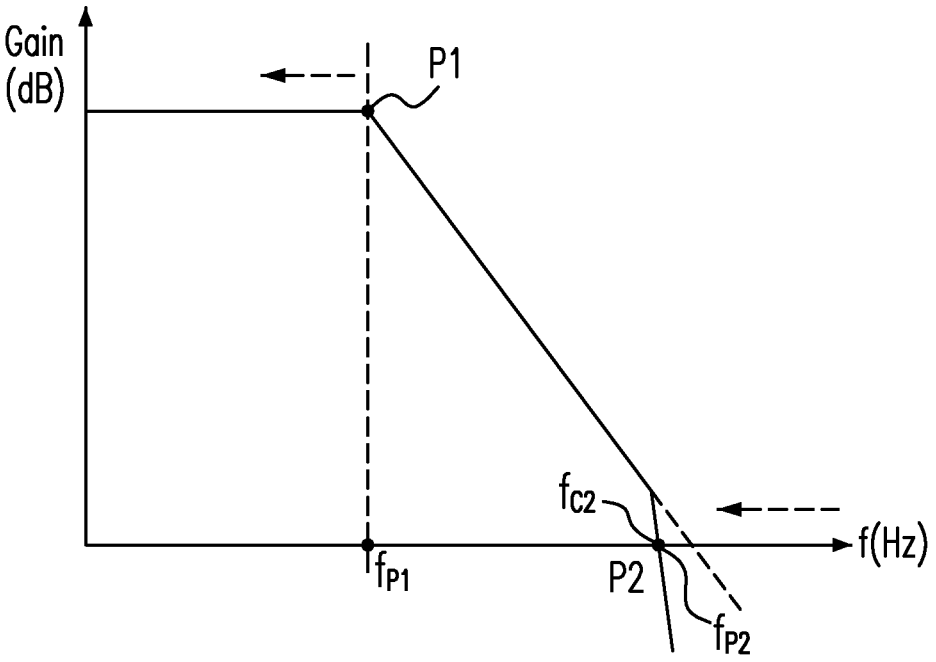
FIG. 9 shows an improvement of stability with reference to FIGS. 2 and 7.

Please refer to FIG. 9, which shows an improvement of stability with reference to FIGS. 2 and 7. A movement of the second pole P2 is in response to the first bias current Iq_act2 or the second bias current Iq_stb2 in FIG. 2. When the second bias current Iq_stb2 in FIG. 2 is decreased in the standby mode, the second pole P2 moves towards the direction of low frequency. Because the second pole frequency (also called cutoff frequency) $f_{P2}=1/(2\pi*Rpa*Cpa)$ can be derived from Eq. 1, the decreased second bias current Iq_stb2 in FIG. 2 in standby mode means that an equivalent resistance of the resistor Rpa increases, and thus the second pole frequency $f_{P2}$ is decreased. Accordingly, the first cutoff frequency $f_{C1}$ moves to lower frequency, the second cutoff frequency $f_{C2}$, and the additional phase margin is obtained, i.e., elevating the stability.

Figure 10:
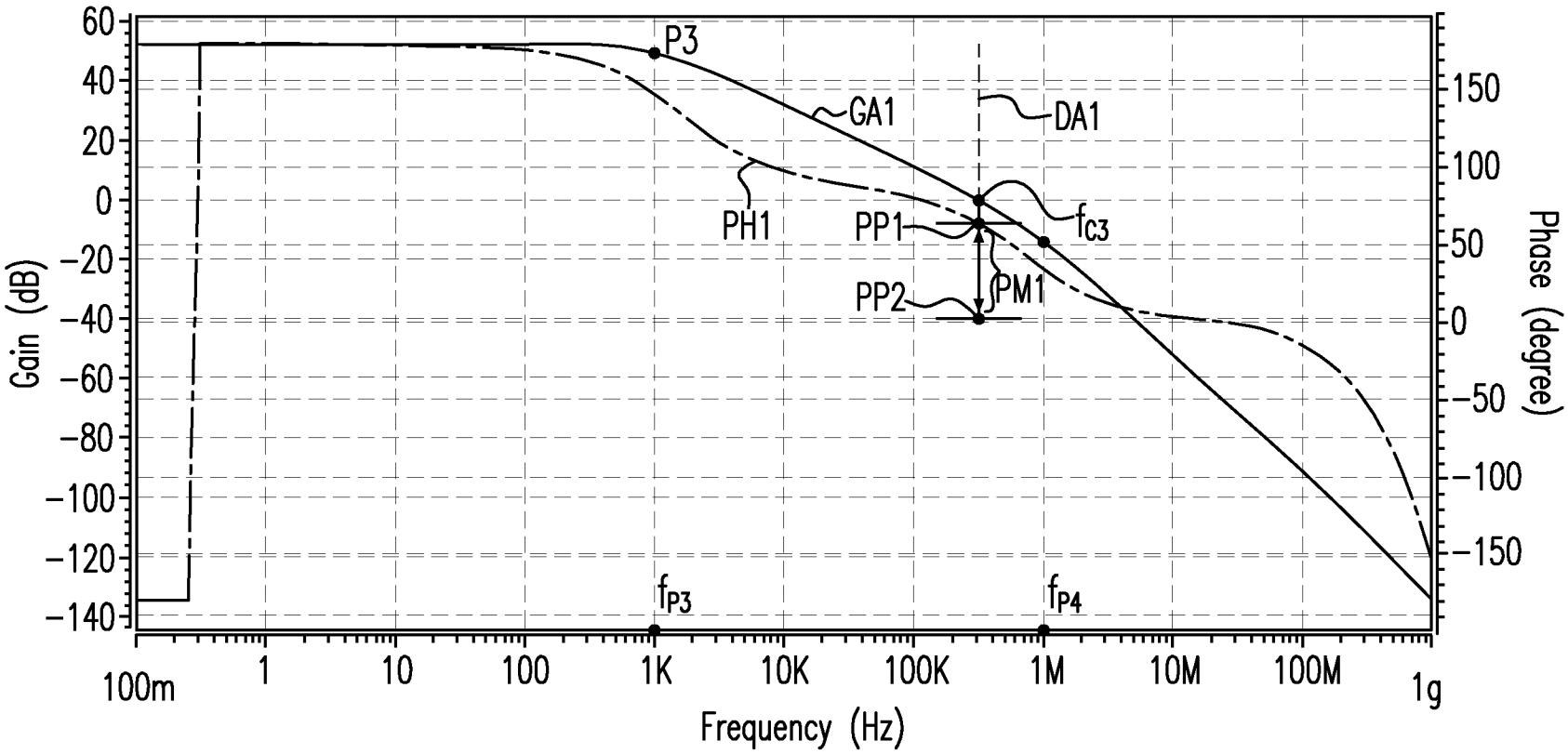
FIG. 10 shows a bode plot of a preferred embodiment in a relatively high current mode with reference to FIGS. 2 and 7.

Please refer to FIG. 10, which shows a bode plot of a preferred embodiment in a high current mode with reference to FIGS. 2 and 7. In FIG. 10, the horizontal axis shows the frequency of the output voltage $V_{O2}$ having a unit of hertz. The left vertical axis shows a gain of the output voltage $V_{O2}$ having a unit of decibel, and the right vertical axis shows a phase of the output voltage $V_{O2}$ having a unit of degree. A first pole frequency $f_{P3}$ of a first pole P3 and a second pole frequency $f_{P4}$ of a second pole P4 are near 1 k Hz and 1M Hz respectively. A cutoff frequency $f_{C3}$ is the intersection of a gain curve GA1 and a zero dB horizontal dash line. A perpendicular dash line DA1 drawn at the cutoff frequency $f_{c3}$ intercepts a phase line PH1 at a point PP1 and a zero degree horizontal dash line at PP2. In FIG. 10, a phase margin PM1 derived from the point PP1 and the point PP2 is about 50 degree, which means the phase of the output voltage $V_{O2}$ is fall behind about 130 degree at the first cut off frequency $f_O$, and is still in the stable state. In the high current mode, the load current $I_{LOAD2}$ is for example about typical value 100 mA, and the first bias current Iq_act2 is about 600 μA when the LDO regulator circuit 20 is operated in the active mode.

Figure 11:
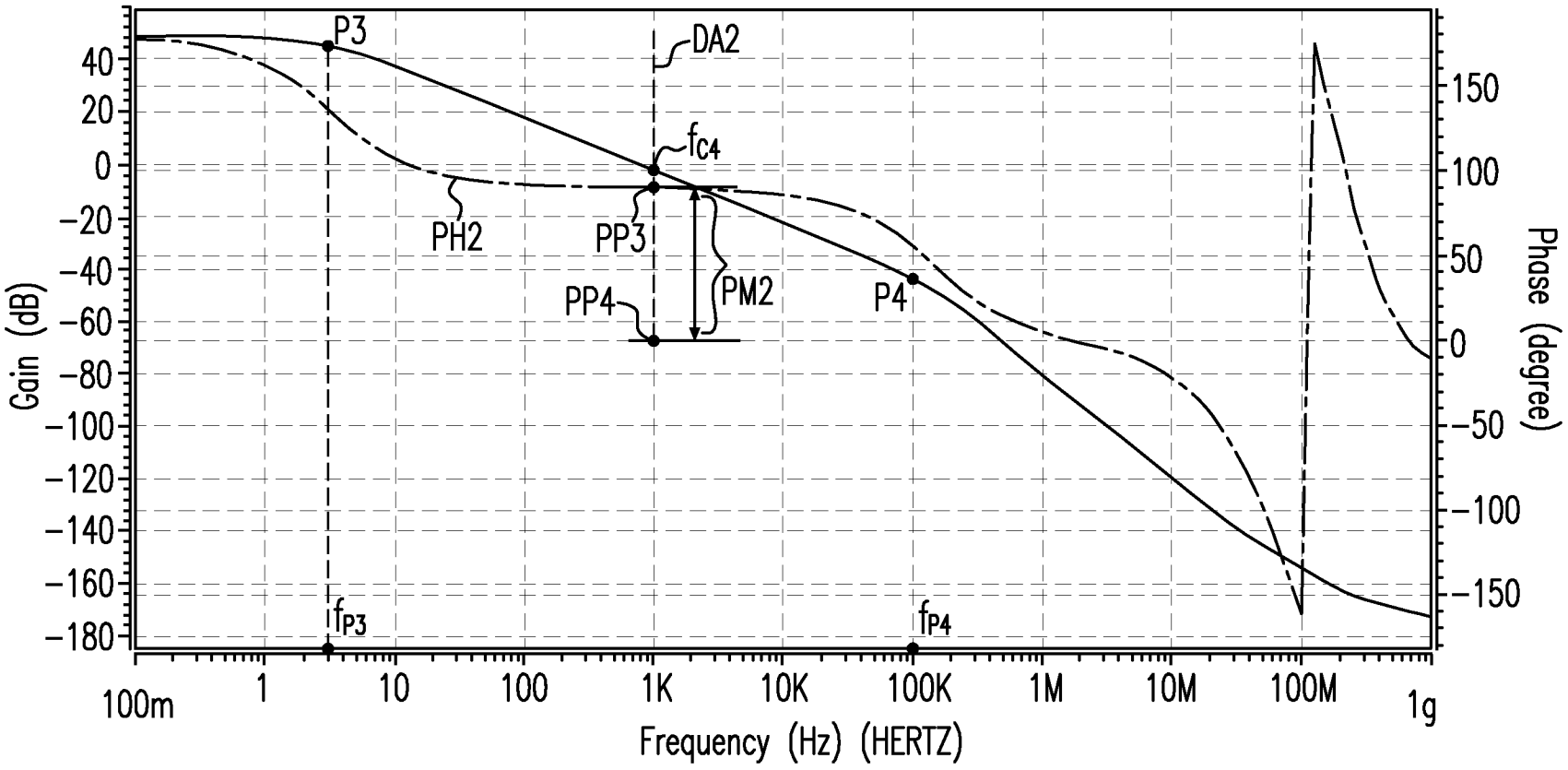
FIG. 11 shows a bode plot of a preferred embodiment in a relatively low current mode with reference to FIGS. 2 and 7.

Please refer to FIG. 11, which shows a bode plot of a preferred embodiment in a low current mode with reference to FIGS. 2 and 7. The first pole frequency $f_{P3}$ of the first pole P3 and the second pole frequency $f_{P4}$ of the second pole P4 are near 5 Hz and 100 k Hz respectively, which means the second pole frequency $f_{P4}$ can be lowered when the first pole frequency $f_{P3}$ is decreased and the output voltage $V_{O2}$ can still keep stable. A cutoff frequency $f_{C4}$ is the intersection of a gain curve GA2 and the zero dB horizontal dash line. A perpendicular dash line DA2 drawn at the cutoff frequency $f_{C4}$ intercepts a phase line PH2 at a point PP3 and a zero degree horizontal dash line at PP4. In FIG. 11, a phase margin PM2 derived from the point PP3 and the point PP4 is about 90 degree, which means the phase of the output voltage $V_{O2}$ is fall behind about 90 degree at the first cut off frequency $f_{C4}$, and is still in the stable state. In the low current mode, the load current $I_{LOAD2}$ is for example about typical value 10 μA, and the second bias current is about 60 μA when the LDO regulator circuit 20 is operated in the standby mode.

According to FIG. 11, it is known that the second bias current Iq_stb2 can be decreased and the phase margin PM2 can still keep in a acceptable range. For example, the second bias current Iq_stb2 is down below 20 μA and the phase margin PM2 can still keep in near 50 degree simultaneously. The above illustrated embodiments can greatly contribute to low power consumption without sacrifice the stability.

When a stability condition resulting from the load current $I_{LOAD2}$, the first bias current Iq_act2, or the second bias current Iq_stb2 is unpredictable, the proposed LDO regulator circuits 30, 40, 50 in FIGS. 4-6 can be flexible to be arranged in a chip for dynamic calibration. For example, a non-volatile memory (not shown) restoring a set of selecting codes can be used to assign the selection portion 26 or the adjustor 36 to select corresponding switch. When a stability condition doesn't fit the requirement by using one selecting code, another selecting code can be applied until a best optimization is reached.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A regulator having a load current, comprising:

an amplifier;

a power transistor coupled to the amplifier;

a parasitic capacitor having a parasitic capacitance;

a parasitic resistor having a parasitic resistance;

a bias circuit coupled to the amplifier and supplying a first bias current to the amplifier in a first mode of a system including the regulator, and a second bias current to the amplifier in a second mode of the system; and a current trimming circuit coupled to the bias circuit to adjust the first bias current according to the load current of the regulator, wherein:

the bias circuit comprises a first bias current source for supplying the first bias current and a second bias current source for supplying the second bias current; and the parasitic capacitance and the parasitic resistance determine a second pole moving in response to one of the first bias current and the second bias current.

2. The regulator of claim 1, wherein the current trimming circuit is also coupled to the second bias current source to adjust the second bias current.

3. The regulator of claim 1, further comprising a second current trimming circuit coupled to the second bias current source to adjust the second bias current.

4. The regulator of claim 1, wherein the first mode is an active mode and the second mode is a standby mode, the first bias current source and the second bias current source are directly connected to the amplifier, the regulator is an LDO regulator which has an output voltage, the amplifier has an output terminal electrically connected to the power transistor regulating the output voltage, and the current trimming circuit stabilizes the output voltage regardless which mode the regulator is working in.

5. The regulator of claim 4, wherein the power transistor is coupled to an external capacitor having a load capacitance and an equivalent load having a load resistance, the load capacitance and the load resistance determine a first pole, and the LDO regulator outputs the load current and the first pole moves in response to the load current.

6. The regulator of claim 4, wherein the power transistor is a power MOSFET whose gate is coupled to the parasitic capacitor and the parasitic resistor, and the regulator further comprises a voltage supply circuit providing a reference voltage to the amplifier, wherein the reference voltage is a constant.

7. The regulator of claim 1, further comprising a first switch coupled between the first bias current source and a ground terminal, a second switch coupled between the second bias current source and the ground terminal, an inverter coupled to the first switch and the second switch, and a control signal, wherein the control signal turns on one of the first switch and the second switch for enabling one of the first mode and the second mode.

8. The regulator of claim 1, wherein the current trimming circuit includes a current mirror having a plurality of drive transistors and a current selection unit selecting one of the plurality of drive transistors.

9. A method of adjusting a bias current of a regulator having an output voltage, an amplifier and a load current, comprising:

providing a plurality of current sources in parallel;

providing codes to activate at least one of the plurality of current sources;

supplying the bias current to the amplifier having a parasitic capacitance and a parasitic resistance in the regulator, wherein the bias current is generated by the at least one of the plurality of current sources, and the bias current is adjustable according to the load current of the regulator;

varying the parasitic resistance in response to the bias current;

identifying a second pole for the parasitic capacitance and the parasitic resistance, wherein the second pole appears at a second relevant frequency which is decreased when the bias current is decreased; and identifying a phase margin according to the second frequency on which the output voltage is stable.

10. The method of claim 9, further comprising: receiving codes to turn on at least one of switch transistors in the plurality of current sources; and summing up each of driving currents generated from switch transistors being turned on.

11. The method of claim 9, further comprising:

providing a divided voltage and a constant reference voltage to the amplifier; and performing one of turning on and off a power switch to regulate an output voltage of the regulator according to difference of the divided voltage and the constant reference voltage.

12. The method of claim 9, further comprising:

responding to the load current of the regulator to vary a load resistance; and determining a first pole according to a load capacitance and the load resistance of the regulator, wherein the first pole has a first frequency and the first frequency is decreased when the load current is decreased.

13. A current trimming device comprising:

a first device including a current drive unit and a plurality of current sources in parallel and supplying a bias current to an amplifier; and a second device including a current selector for activating at least one of the plurality of current sources based on a select signal, wherein the bias current is adjustable according to a load current of a power component coupled to the amplifier, wherein:

the current drive unit includes a first array of transistors and a second array of switches, wherein the second array of switches are respectively coupled to the first array of transistors; each transistor of the first array of transistors is electrically connected to the amplifier; and the current selector is a decoder having a plurality of control lines respectively electrically connected to switches of the second array to activate the at least one of the plurality of current sources based on the select signal.

14. The device of claim 13, further comprising a plurality of transistors, wherein the first device comprises a bias circuit including a first bias current source coupled to the amplifier for supplying a first bias current to the amplifier in a first mode and a second bias current source for supplying a second bias current to the amplifier in a second mode, the amplifier is coupled to the power component and regulates an output voltage of the power component, and the output voltage keep stabilized when the bias current is reduced to a minimum determined by a circuit pre-simulation, wherein the select signal turns on at least one of the plurality of transistors for activating corresponding current sources, when only a specific bias current is selected from the plurality of different bias currents, the current trimming device provides the selected specific of the plurality of different bias currents to the amplifier to keep the output voltage stable, when plural bias currents are selected from the plurality of different bias currents, the current trimming device provides a collective bias current combining the selected plural ones of the plurality of different bias currents to the amplifier to keep the output voltage stable, and when the selected at least one bias current is optimal, one of the selected specific bias current and the bias current has a value equal to the minimum of the stabilizing bias current, and wherein the first device includes a current mirror, the current drive unit includes the first array of transistors being NMOS drive transistors and the second array of transistors being NMOS switches, each of the transistors in the first array has a source terminal, a drain terminal, a gate channel width and a gate channel length, each of the switches in the second array is coupled to a corresponding source terminal of those of the transistors in the first array, all drain terminals of the transistors in the first array are electrically connected to the amplifier, the respective ratios of the gate channel widths to the gate channel lengths of the transistors in the first array are mutually different for supplying the plurality of different bias currents, and the second device selects only one of switches in the second array based on the determination.

15. The circuit of claim 13, wherein the first device includes a current source unit and a current drive unit, the current source unit includes an independent current source and a first n-type MOSFET having a first drain terminal and a first gate electrically connected to the first drain terminal, the current drive unit includes a first array of NMOS drive transistors and a second array of NMOS switches, each of the transistors in the first array has a source terminal, a drain terminal, a gate channel width and a gate channel length, each of the switches in the second array has a gate and is coupled to a corresponding source terminal of the transistors in the first array, all drain terminals of the transistors in the first array are electrically connected to the amplifier, the respective ratios of the gate channel widths to the gate channel lengths of the transistors in the first array are mutually different for supplying the plurality of different bias currents, the second device selects an optimal combination of the switches in the second array based on the determination, and the current selector is the decoder having a plurality of control lines respectively electrically connected to corresponding gates of the switches in the second array for generating an optimal combination of the plurality of different bias currents.

16. The circuit of claim 13, wherein the first device comprises a bias circuit including a second bias current source, a second current trimming circuit is coupled to the second bias current source to adjust a second bias current, the amplifier is coupled to a power component and regulates an output voltage of the power component, the output voltage is stabilized by a stabilizing bias current, and the stabilizing bias current has a minimum, wherein when only a specific bias current is selected from the plurality of different bias currents, the current trimming device provides the selected specific of the plurality of different bias currents to the amplifier to keep the output voltage stable, when plural bias currents are selected from the plurality of different bias currents, the current trimming device provides a collective bias current combining the selected plural ones of the at least one of the plurality of different bias currents to the amplifier to keep the output voltage stable, and when the selected at least one bias current is optimal, one of the selected specific bias current and the collective bias current has a value equal to the minimum of the stabilizing bias current, and wherein the first device includes a current source unit, a current drive unit and a current mirror, the second device includes a current adjuster, the current source unit includes a first array of PMOS switches and a second array of resistors, the switches in the first array are controlled by a selecting signal generated from the current adjuster, the resistors in the second array have respective resistances which are mutually different, and the second device turns on only one of switches in the first array based on the determination.

17. The circuit of claim 13, wherein the first device includes a current source unit, the second device includes a current adjuster generating a selecting signal, the current source unit includes a first array of PMOS switches and a second array of resistors having a same resistance, the switches are controlled by the selecting signal, and the current adjuster optionally turns on the first array of PMOS switches for generating a corresponding bias current.

* * * * *